US006978742B2

(12) United States Patent
Miyagawa et al.

(10) Patent No.: US 6,978,742 B2
(45) **Date of Patent: *Dec. 27, 2005**

(54) ENGINE COOLING WATER PASSAGE STRUCTURE AND GAS/LIQUID SEPARATOR FOR ENGINE COOLING SYSTEM

(75) Inventors: Susumu Miyagawa, Saitama (JP); Masanori Hashimoto, Saitama (JP); Naoki Hotta, Saitama (JP); Shinji Yoshinari, Tochigi (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/898,314

(22) Filed: Jul. 26, 2004

(65) Prior Publication Data

US 2005/0045119 A1 Mar. 3, 2005

Related U.S. Application Data

(63) Continuation of application No. 10/173,582, filed on Jun. 18, 2002, now Pat. No. 6,843,209.

(30) Foreign Application Priority Data

Jun. 20, 2001 (JP) ..... 2001-186324
Jun. 20, 2001 (JP) ..... 2001-186325

(51) Int. Cl.[7] ..... F01P 7/14
(52) U.S. Cl. ..... 123/41.1; 123/41.44
(58) Field of Search ..... 123/41.1, 41.44, 123/41.46, 41.47

(56) References Cited

U.S. PATENT DOCUMENTS

| | | | |
|---|---|---|---|
| 2,852,009 | A | 9/1958 | Turlay |
| 4,662,320 | A | 5/1987 | Moriya |
| 6,112,706 | A | 9/2000 | Heer |
| 6,260,515 | B1 | 7/2001 | Tosaka et al. |
| 6,394,059 | B2 | 5/2002 | Guzman |

FOREIGN PATENT DOCUMENTS

| | | |
|---|---|---|
| JP | 4-16610 | 3/1992 |
| JP | 5-83322 | 11/1993 |

*Primary Examiner*—Noah P. Kamen
(74) *Attorney, Agent, or Firm*—Arent Fox PLLC

(57) ABSTRACT

An engine cooling water passage structure includes a cooling water passage unit that is formed by integrating a water pump for supplying cooling water, a thermostat housing for housing a thermostat, a gas/liquid separation chamber for separating air from the cooling water, cooling water supply passages for supplying to water jackets, via the thermostat housing and the water pump, the cooling water that has been returned from a radiator, cooling water discharge passage for discharging into the radiator the cooling water that has passed through the water jackets, and a bypass passage for returning to the thermostat housing the cooling water that has passed through the water jackets, while bypassing the radiator. This cooling water passage unit is detachably mounted as a unit on an engine main body. Thus, the arrangement allows the engine cooling system to be made compact.

2 Claims, 8 Drawing Sheets

ENGINE COOLING WATER PASSAGE STRUCTURE AND GAS/LIQUID SEPARATOR FOR ENGINE COOLING SYSTEM

This is a Continuation Application of application Ser. No. 10/173,582 filed Jun. 18, 2002, now U.S. Pat. No. 6,843,209, which claims priority under 35 U.S.C. §119, to foreign applications Nos. 2001-186324 and 2001-186325 both filed in Japan. The disclosure of prior applications is hereby incorporated by reference.

BACKGROUND OF THE INVENTION

1. Field of the Invention

The present invention relates to an engine cooling water passage structure in which a water pump, a thermostat housing, a cooling water supply passage, a cooling water discharge passage, and a bypass passage are made into a unit.

The present invention also relates to a gas/liquid separator for an engine cooling system in which cooling water supplied from a water pump is circulated through a water jacket formed in an engine main body, and a gas/liquid separation chamber for separating air from the cooling water is disposed in a cooling water passage leading to the water jacket.

2. Description of the Related Art

Japanese Patent Publication No. 4-16610 discloses an arrangement in which cooling water that has passed through water jackets provided on a pair of banks of a V-type engine is combined in a cooling water discharge passage at one end of the V banks and then supplied to a radiator via a first radiator hose. The cooling water that has passed through the radiator is supplied to the water jackets via a second radiator hose, a thermostat housing disposed on one end of the V banks. A connecting passage is disposed between the V banks, and a water pump is disposed on the other end of the V banks. Two cooling water supply passages branch out from the water pump and before the engine is fully warmed up, the cooling water in the cooling water discharge passage is returned to the connecting passage via a bypass passage and the thermostat housing without being supplied to the radiator.

In this conventional engine cooling water passage structure, elements such as the thermostat housing, the water pump, the cooling water supply passage, the cooling water discharge passage, the connecting passage, and the bypass passage are provided independently, thereby leading to problems associated with the increase in the number of components, the number of assembling steps, the space required, and the cost.

Furthermore, in a cooling system in which air that is in the cooling water is not introduced into a radiator when an engine is stopped, the air cannot be discharged through a pressure cap provided in an upper tank of the radiator. Therefore, an expansion tank equipped with a pressure cap is provided separately. The cooling water containing air is supplied to this expansion tank via an upper part of a water jacket so that the air is discharged via the pressure cap. Such an expansion tank is known in, for example, Japanese Utility Model Registration Application Laid-open No. 5-83322.

However, the expansion tank not only requires space for accommodating an increase in the volume of the cooling water due to an increase in temperature, thereby resulting in an increase in the tank capacity, but it also requires a labyrinth structure for reliably separating the air by reducing the flow rate of the cooling water, resulting in an increase in the cost.

SUMMARY OF THE INVENTION

The present invention has been achieved in view of the above-mentioned circumstances, and it is a first object of the present invention to provide a compact engine cooling system that includes a water pump, a thermostat housing, a cooling water supply passage, a cooling water discharge passage, and a bypass passage.

A second object of the present invention is to reliably separate air from cooling water without requiring a large expansion tank having a complicated structure.

In order to accomplish the above-mentioned first object, in accordance with a first aspect of the present invention, there is proposed an engine cooling water passage structure that includes a cooling water passage unit that integrates: a water pump for supplying cooling water; a thermostat housing for housing a thermostat; a cooling water supply passage for supplying, to a water jacket, via the thermostat housing and the water pump, the cooling water that has been returned from a radiator; a cooling water discharge passage for discharging into the radiator the cooling water that has passed through the water jacket; and a bypass passage for returning to the thermostat housing the cooling water that has passed through the water jacket, while bypassing the radiator; wherein the cooling water passage unit is detachably mounted as a unit on an engine main body.

In accordance with this arrangement, since the water pump, the thermostat housing, the cooling water supply passage, the cooling water discharge passage, and the bypass passage are integrated to form a cooling water passage unit, it becomes possible to mount, as a unit on the engine main body, the cooling water passage unit that has been pre-assembled as a sub-assembly, thereby reducing the number of components, the number of assembling steps, the space, and the cost in comparison with a case where various components forming engine cooling water passages are assembled individually.

Furthermore, in order to accomplish the above-mentioned first object, in accordance with a second aspect of the present invention, in addition to the above-mentioned first aspect, there is proposed an engine cooling water passage structure wherein the cooling water passage unit includes a mating surface that is joined to the engine main body, and the cooling water supply passage and the cooling water discharge passage of the cooling water passage unit communicate with the water jacket of the engine main body via the mating surface.

In accordance with this arrangement, joining the mating surface of the cooling water passage unit to the engine main body allows the cooling water supply passage and the cooling water discharge passage of the cooling water passage unit to communicate with the water jacket of the engine main body via the mating surface, and it is therefore unnecessary to employ special piping for communicating the cooling water discharge passage and the water jacket with the cooling water supply passage, thereby further reducing the number of components.

Moreover, in order to accomplish the above-mentioned first object, in accordance with a third aspect, in addition to the above-mentioned first or second aspect, there is proposed an engine cooling water passage structure wherein the cooling water passage unit is formed integrally with a gas/liquid separation chamber for separating a gas phase from the cooling water.

In accordance with this arrangement, since the gas/liquid separation chamber for separating the gas phase from the cooling water is provided integrally in the cooling water passage unit, the gas phase contained in the cooling water can be separated, and the number of steps required for assembling the gas/liquid separation chamber can also be reduced.

Furthermore, in order to accomplish the above-mentioned first object, in accordance with a fourth aspect of the present invention, in addition to the above-mentioned first or second aspect, there is proposed an engine cooling water passage structure wherein a bypass pipeline for introducing the cooling water that has passed through the water jacket into the bypass passage of the cooling water passage unit is disposed between V banks of a V-type engine.

In accordance with this arrangement, since the bypass pipeline for introducing the cooling water into the bypass passage of the cooling water passage unit is disposed between the V banks of the V-type engine, the space between the V banks can be utilized to effectively arrange the bypass pipeline in a compact manner.

Moreover, in order to accomplish the above-mentioned first object, in accordance with a fifth aspect of the present invention, in addition to the above-mentioned first or second aspect, there is proposed an engine cooling water passage structure wherein at least one part of the cooling water passage unit is disposed between V banks of a V-type engine.

In accordance with this arrangement, since at least one part of the cooling water passage unit is disposed between the V banks of the V-type engine, the space between the V banks can be utilized effectively for arranging the cooling water passage unit in a compact manner.

Moreover, in order to accomplish the above-mentioned second object, in accordance with a sixth aspect of the present invention, there is proposed a gas/liquid separator for an engine cooling system for circulating, to a water jacket formed in an engine main body, cooling water that has been supplied from a water pump, the gas/liquid separator including: a gas/liquid separation chamber for separating air from the cooling water, the gas/liquid separation chamber being disposed in a cooling water passage leading to the water jacket; and a pressure cap is provided in an upper part of the gas/liquid separation chamber, the pressure cap including a built-in pressure control valve that opens at a predetermined internal pressure to vent air; wherein the gas/liquid separation chamber is formed in a substantially cylindrical shape and comprises: an inlet in which the cooling water flows and which opens tangentially to an inner wall of the gas/liquid separation chamber; and an outlet out of which the cooling water flows and which opens to the direction in which the cooling water flows and opens tangentially to the inner wall of the gas/liquid separation chamber.

In accordance with this arrangement, since the gas/liquid separation chamber provided in the cooling water passage leading to the water jacket is formed in a substantially cylindrical shape, the inlet in which the cooling water flows and the outlet out of which the cooling water flows open tangentially to the inner wall of the gas/liquid separation chamber. The pressure cap that includes the built-in pressure control valve is provided in the upper part of the gas/liquid separation chamber. The cooling water that flows in the inlet can generate a spiral flow within the gas/liquid separation chamber thus forming the water surface into a conical shape, thereby not only retaining a gas phase in the upper part of the gas/liquid separation chamber but also ensuring smooth outflow of the cooling water through the outlet. Furthermore, when the internal pressure of the gas/liquid separation chamber increases in response to an increase in the temperature of the cooling water and the pressure control valve of the pressure cap opens, only the gas phase, which resides in the upper part of the gas/liquid separation chamber, can be vented to the outside reliably. Moreover, since water can be poured into the engine cooling system from the gas/liquid separation chamber with the pressure cap taken off, it is unnecessary to pour water into the engine cooling system through a radiator, thereby making it possible to lower the position of the radiator and increasing the degrees of freedom in the design of a vehicle. Furthermore, since the gas/liquid separation chamber can be formed from a simple cylindrical member having an inlet and an outlet, its cost is extremely low.

Moreover, in order to accomplish the above-mentioned second aspect, in accordance with a seventh aspect of the present invention, and in addition to the sixth aspect, there is proposed a gas/liquid separator for an engine cooling system wherein the inlet for the cooling water is positioned at the same height as or higher than the outlet.

In accordance with this arrangement, since the inlet for the cooling water is positioned at the same height as or higher than the outlet, when water is poured into the gas/liquid separation chamber with the pressure cap taken off, the amount of air that is supplied together with the cooling water to the cooling system through the outlet can be minimized.

Furthermore, in order to accomplish the above-mentioned second object, and in accordance with an eighth aspect of the present invention, in addition to the above-mentioned sixth or seventh aspect, there is proposed a gas/liquid separator for an engine cooling system wherein the pressure cap is disposed in the center of the substantially cylindrical gas/liquid separation chamber.

In accordance with this arrangement, since the pressure cap is disposed in the center of the substantially cylindrical gas/liquid separation chamber, the pressure cap can be positioned in an area where the gas phase is the thickest above the surface of the water that is formed into a conical shape by the spiral flow, thereby further reliably separating air from the cooling water and venting it.

The engine main body of the present invention corresponds to a cylinder head 11 and a cylinder block 13 of an embodiment, and the cooling water supply passage of the present invention corresponds to an upstream cooling water supply passage P2 and a downstream cooling water supply passage P3 of the embodiment.

The above-mentioned objects, other objects, characteristics and advantages of the present invention will become apparent from an explanation of a preferred embodiment that will be described in detail below by reference to the attached drawings.

BRIEF DESCRIPTION OF THE DRAWINGS

FIG. 1 is a circuit diagram of cooling water passages for a V-type engine (when a thermostat is open).

FIG. 2 is an exploded oblique view of a cooling water passage unit taken from one direction.

FIG. 3 is an exploded oblique view of the cooling water passage unit taken from another direction.

FIG. 4 is a longitudinal cross section of the cooling water passage unit.

FIG. 5 is a view from arrows 5—5 in FIG. 4.

FIG. 6 is a cross section along line 6—6 in FIG. 5.

FIG. 7 is an oblique view of a V-type engine equipped with the cooling water passage unit.

FIG. 8 is a circuit diagram of the cooling water passages corresponding to FIG. 1 (when the thermostat is closed).

DESCRIPTION OF PREFERRED EMBODIMENT

An embodiment of the present invention is explained below by reference to the attached drawings.

Figure 1:
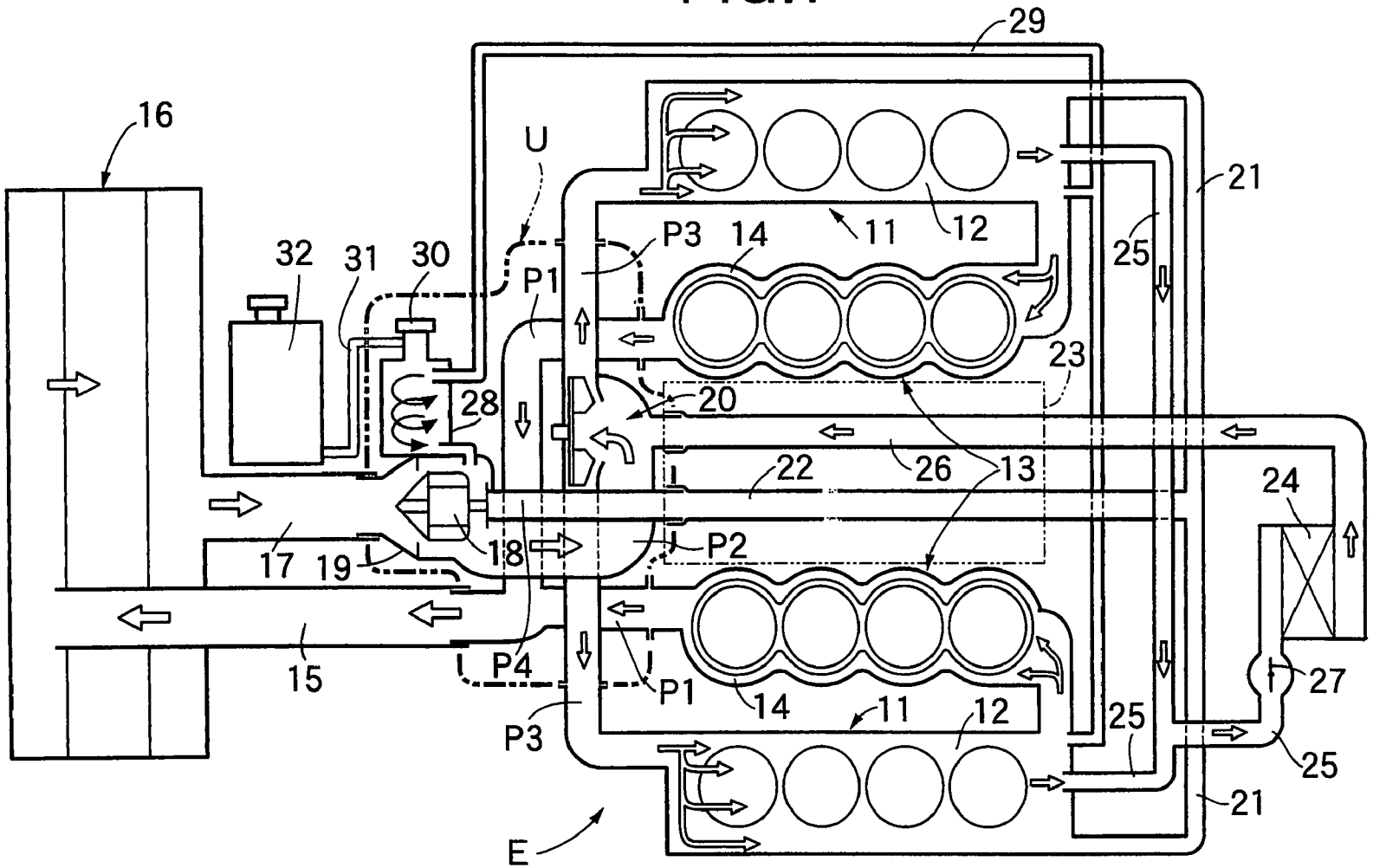
FIGS. 1 to 8 show one embodiment of the present invention.

Referring to FIG. 1, a cooling water circuit for a V-type engine E is explained.

The V-type engine E mounted in a vehicle includes a pair of water jackets 12 of cylinder heads 11 and a pair of water jackets 14 of cylinder blocks 13. The water jackets 14 of the cylinder blocks 13 communicate with a radiator 16 via cooling water discharge passages P1 and a first radiator hose 15, and the radiator 16 communicates with a thermostat housing 19, which includes a built-in thermostat 18, via a second radiator hose 17. The thermostat housing 19 communicates with the water jackets 12 of the cylinder heads 11 via cooling water supply passages P2 and P3. Disposed between the upstream cooling water supply passage P2 and the downstream cooling water supply passages P3 is a water pump 20 that is driven by a crankshaft of the engine E.

The upstream ends of bypass pipelines 21 and 22 lead to the ends of the water jackets 12 of the cylinder heads 11 on the side that is opposite to the side on which the downstream cooling water supply passages P3 are connected thereto. A bypass pipeline 22 on the downstream side runs through between V banks 23 of the engine E and communicates with the thermostat housing 19 via a bypass passage P4. In order to circulate a part of the high temperature cooling water through a heater core 24 for heating an occupant compartment, the upstream ends of heater core pipelines 25 and 26 lead to the water jackets 12 of the cylinder heads 11 in the vicinity of the areas where the bypass pipeline 21 are connected thereto. A flow control valve 27 and the heater core 24 are connected in series between the heater core pipeline 25 on the upstream side and a heater core pipeline 26 on the downstream side. The heater core pipeline 26 on the downstream side runs through the space between the V banks 23 of the engine E and communicates with the upstream cooling water supply passage P2.

Since the space between the V banks of the engine E is utilized to arrange the bypass pipeline 22 and the heater core pipeline 26 as described above, space can be saved in comparison with a case where they are arranged so as to fit around the outside of the V banks 23, thereby contributing a reduction in the overall dimensions of the engine E. In particular, integrating the bypass pipeline 22 and the heater core pipeline 26 allows more easy handling of them. Furthermore, integrating the bypass pipeline 21 and the heater core pipeline 25 that communicate with the upstream sides of the bypass pipeline 22 and the heater core pipeline 26 can further save space and reduce the number of assembling steps.

The internal space of a gas/liquid separation chamber 28 provided integrally with the thermostat housing 19 communicates with the water jackets 12 of the cylinder heads 11 via an air vent pipe 29. A pressure cap 30 provided on the upper end of the gas/liquid separation chamber 28 communicates with a cooling water reservoir 32 via an air vent pipe 31. The pressure cap 30 includes a built-in pressure control valve that opens when the internal pressure of the gas/liquid separation chamber 28 exceeds a predetermined value. In order to minimize the amount of air remaining within the water jackets 12 of the cylinder heads 11 when water is initially poured into the cooling system, the upstream end of the air vent pipe 29 is connected to the highest position of the water jackets 12.

The components surrounded by the thick chain line in FIG. 1, that is, the thermostat 18, the thermostat housing 19, the water pump 20, the gas/liquid separation chamber 28, the cooling water discharge passages P1, the upstream cooling water supply passage P2, the downstream cooling water supply passages P3, and the bypass passage P4, form the cooling water passage unit U of the present invention, and they are pre-assembled into a sub-assembly and mounted on the engine E as a unit.

Figure 2:
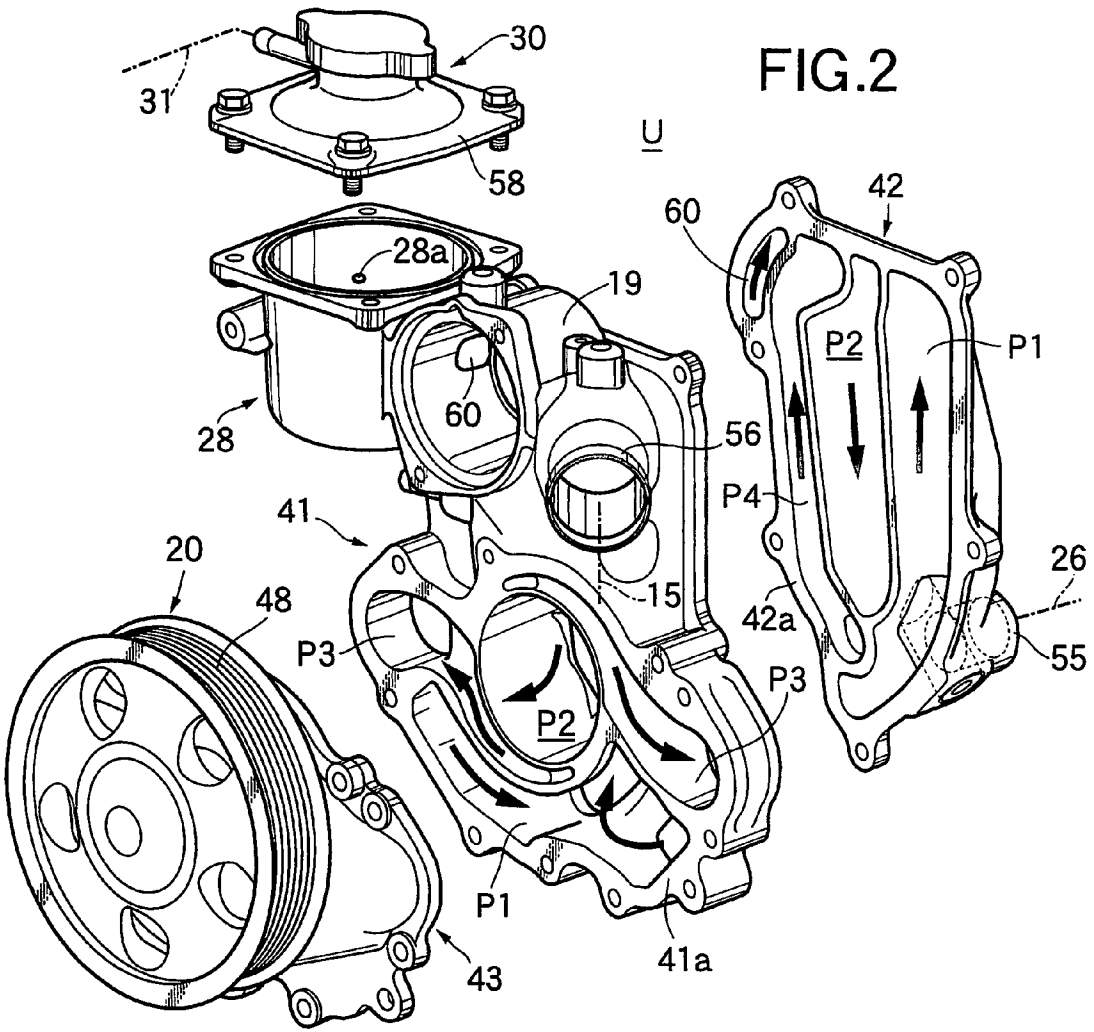
Figure 6:
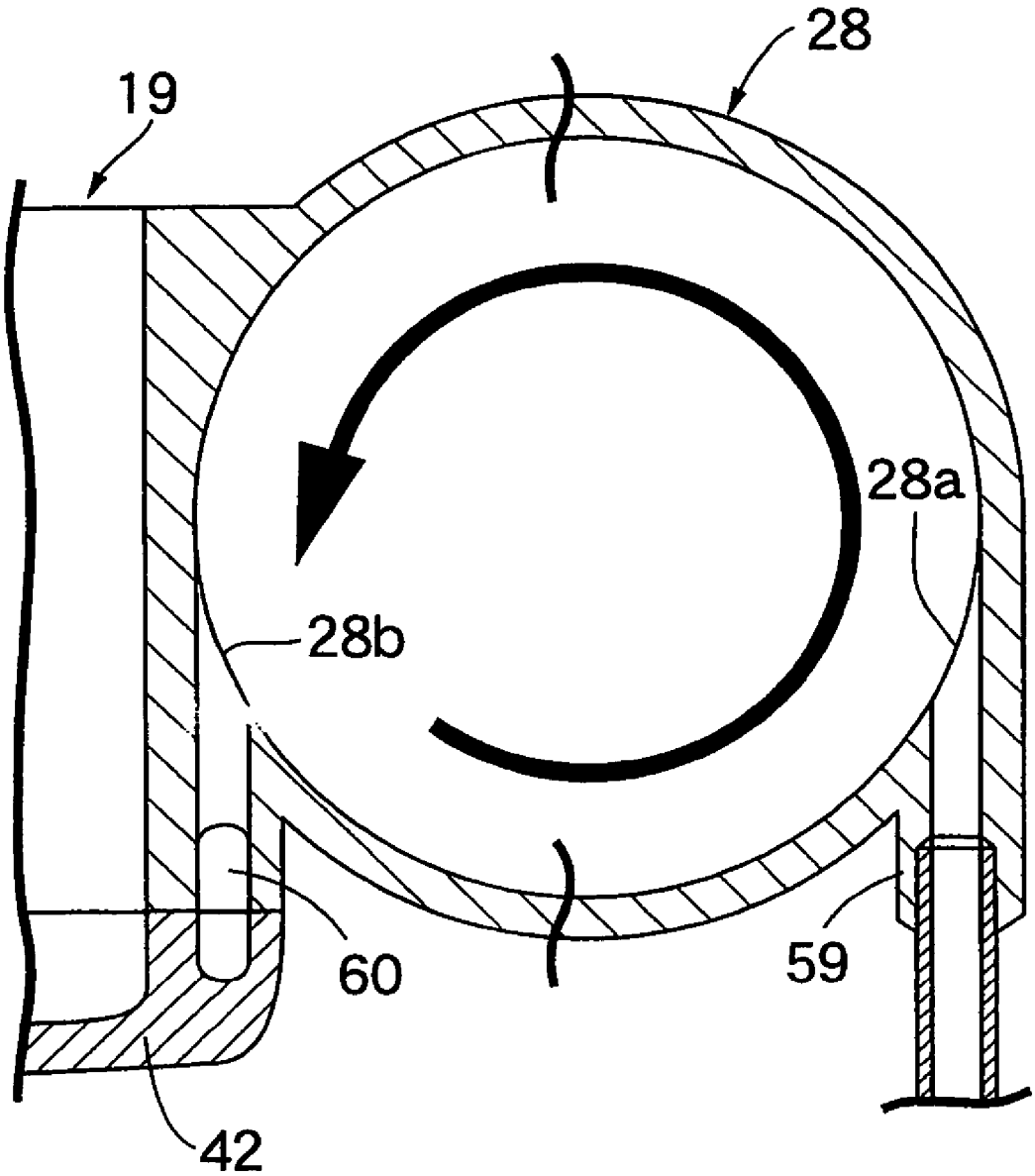

Turning to FIGS. 2 and 6, the structure of the cooling water passage unit U is now explained.

The cooling water passage unit U is divided into three sections, that is, a center casing 41, a rear casing 42, and the water pump 20. The thermostat housing 19 and the gas/liquid separation chamber 28 are provided integrally with the center casing 41.

Figure 4:
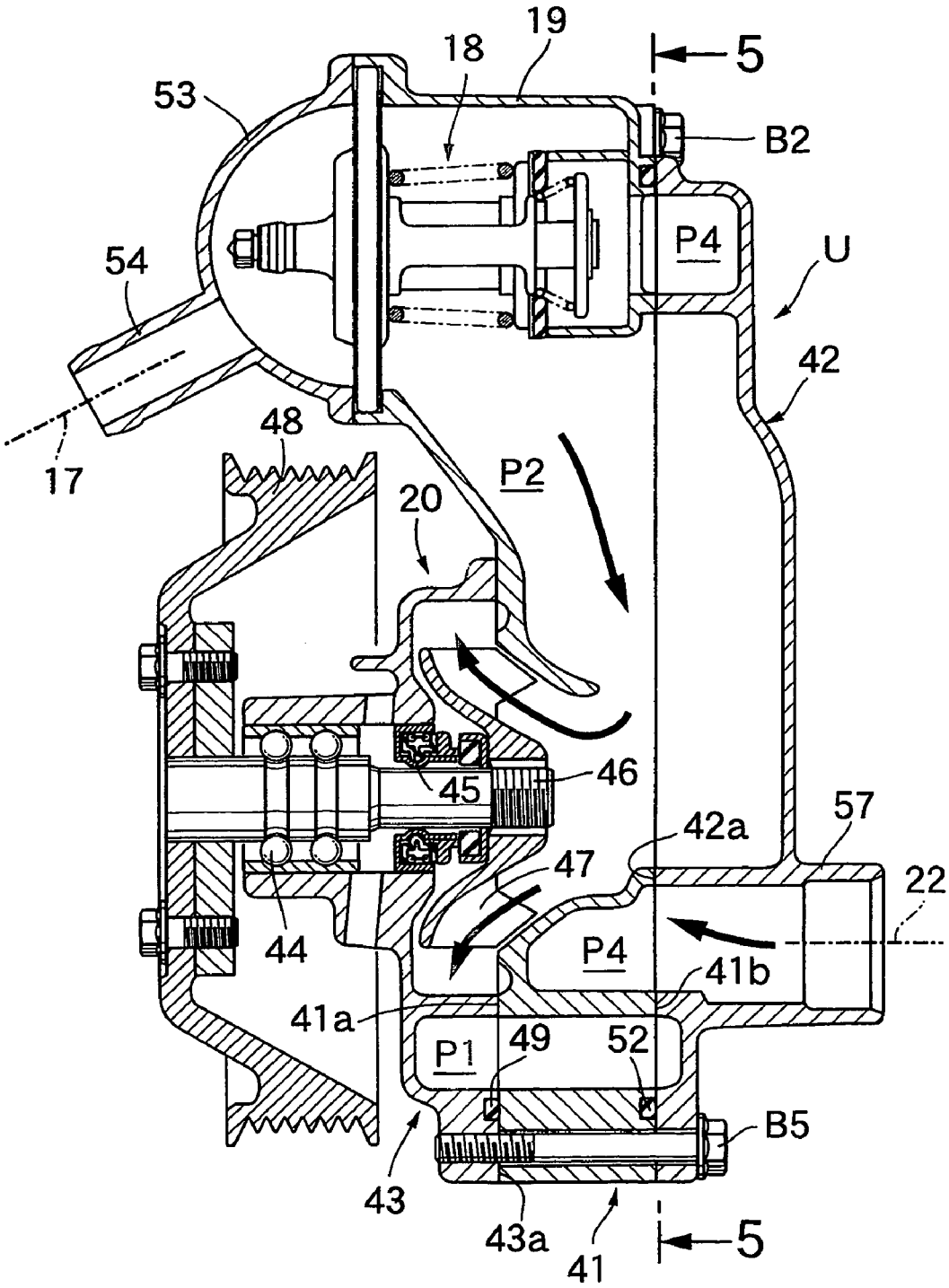

The water pump 20 includes a pump housing 43 having a mating surface 43*a*. A pump shaft 46 is supported in the center of the pump housing 43 via a ball bearing 44 and a mechanical seal 45. A pump impeller 47 is provided on one end of the pump shaft 46, and a pulley 48 is provided on the other end. Formed on the front side in a lower part of the center casing 41 is a mating surface 41*a* to which the mating surface 43*a* of the pump housing 43 of the water pump 20 is joined. Joining the two mating surfaces 43*a* and 41*a* via a sealing member 49 (see FIG. 4) defines a part of the upstream cooling water supply passage P2 (a passage for supplying cooling water to the water pump), the downstream cooling water supply passages P3 (passages for supplying the cooling water from the water pump 20 to the water jackets 12 of the cylinder heads 11), and parts of the cooling water discharge passages P1 (passages for discharging the cooling water from the water jackets 14 of the cylinder blocks 13) between the rear face of the pump housing 43 and the front face of the center casing 41.

Figure 3:
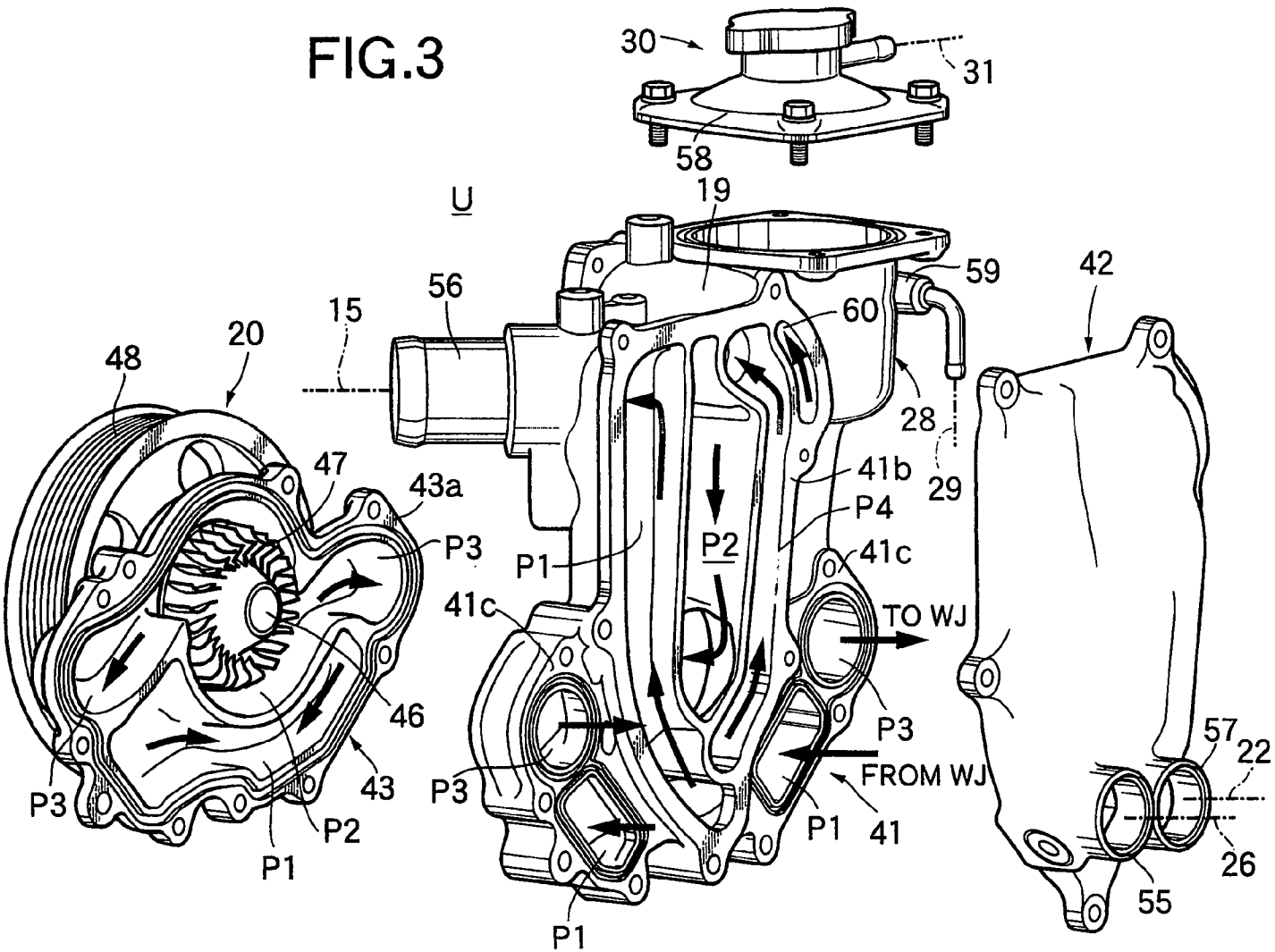

Formed on the rear face of the center casing 41 is a mating surface 41*b* to which a mating surface 42*a* of the rear casing 42 is joined, and formed on the opposite sides in a lower part of the mating surface 41*b* are a pair of left and right mating surfaces 41*c* (see FIG. 3) that are joined to an end face of an engine block, that is, the cylinder heads 11 and the cylinder blocks 13. These two mating surfaces 41*c* together form a V-shape and protrude outward from the outer periphery of the rear casing 42, which is joined to the rear face of the center casing 41. Joining the two mating surfaces 41*c* of the center casing 41 to the engine block via sealing members 50 and 51 (see FIG. 5) therefore allows the cooling water discharge passage P1 opening on the mating surfaces 41*c* to communicate with the water jackets 14 of the cylinder blocks 13 and the downstream cooling water supply passage P3 to communicate with the water jackets 12 of the cylinder heads 11.

Joining the mating surface 41*b* of the center casing 41 and the mating surface 42*a* of the rear casing 42 to each other via a sealing member 52 (see FIG. 4) forms the cooling water discharge passage P1, the upstream cooling water supply passage P2, and the bypass passage P4 between the center casing 41 and the rear casing 42. The lower end of the upstream cooling water supply passage P2 positioned in the center communicates with the interior of the pump housing 43, and the upper end thereof communicates with the interior of the thermostat housing 19. An open end of the thermostat housing 19, which includes the built-in thermostat 18, is covered with a hemispherical cover 53, the cover 53 has a fitting 54 integrally formed therewith, and connected to the fitting 54 is a second radiator hose 17. The lower end of the upstream cooling water supply passage P2 also communicates with the downstream side of the heater core pipeline 26 disposed between the V banks 23 of the engine E via a fitting 55 projecting from the rear face of the rear casing 42. The fitting 55 bends in an L-shaped form within the rear casing 42 and communicates with the upstream cooling water supply passage P2.

The lower end of the cooling water discharge passage P1 formed on one side of the upstream cooling water supply passage P2 communicates with a middle section of the cooling water discharge passage P1 defined between the center casing 41 and the pump housing 43, and the upper end thereof communicates with a first radiator hose 15 via a fitting 56 projecting from the front face of an upper part of the center casing 41. The lower end of the bypass passage P4 formed on the other side of the upstream cooling water supply passage P2 communicates with the bypass pipeline 22 disposed between the V banks 23 of the engine E via a fitting 57 projecting from the rear face of the rear casing 42.

Referring also to FIG. 6, the gas/liquid separation chamber 28 is provided so as to adjoin the thermostat housing 19, its upper face opening is covered with a cover 58, and the pressure cap 30 provided in the center of the cover 58 communicates with the reservoir 32 via the air vent pipe 31. The air vent pipe 29 is connected to a fitting 59 extending to a tangential inlet 28*a* formed in an upper part of the side wall of the cup-shaped gas/liquid separation chamber 28. A tangential outlet 28*b* opening in a lower part of the side wall on the side opposite to the inlet 28*a* communicates with the interior of the thermostat housing 19 via a passage 60 formed between the mating surface 41*b* of the center casing 41 and the mating surface 42*a* of the rear casing 42.

This gas/liquid separation chamber 28 is filled to the top with water when water is initially poured into the cooling system with the pressure cap 30 taken off. Since the gas/liquid separation chamber 28 is positioned at the highest point in the cooling system (see FIG. 7), when cooling water is initially poured therefrom into the cooling system, it is possible to minimize the amount of air remaining in the cooling system. Furthermore, since it is unnecessary to vent air from the cap of the radiator 16, the elevation of the radiator 16 can be lowered, thereby increasing the degrees of freedom in the design of a vehicle.

Figure 5:
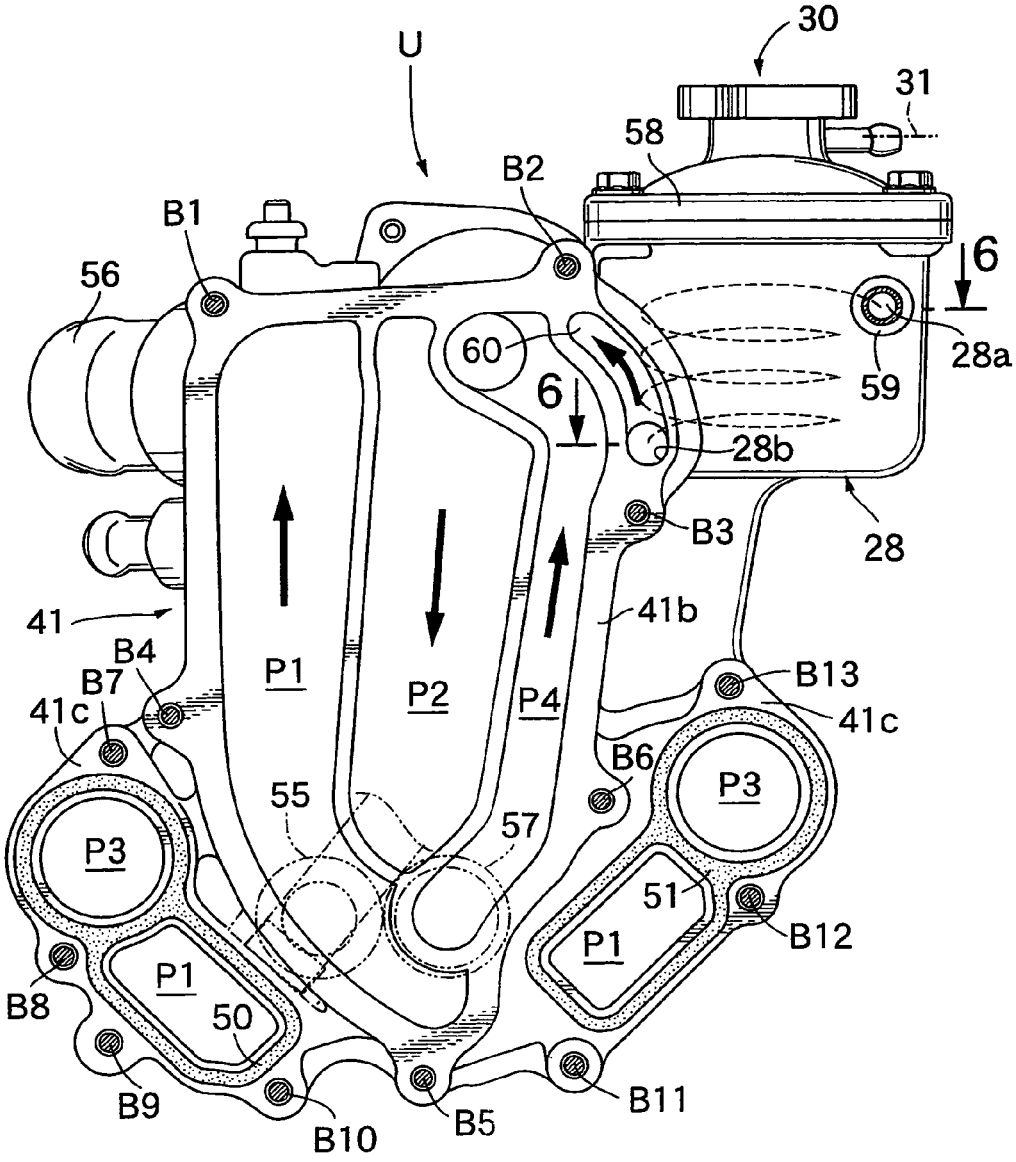

As shown in FIG. 5, three bolts B1 to B3 on the upper side that are inserted from the rear casing 42 side are tightened into the center casing 41, and three bolts B4 to B6 on the lower side that are inserted from the rear casing 42 side run through the center casing 41 and are tightened into the pump housing 43. A total of seven bolts B7 to B13 on the lower left and right sides that are inserted from the pump housing 43 side run through the center casing 41 and are tightened into an engine main body (the cylinder heads 11 and the cylinder blocks 13).

Figure 7:
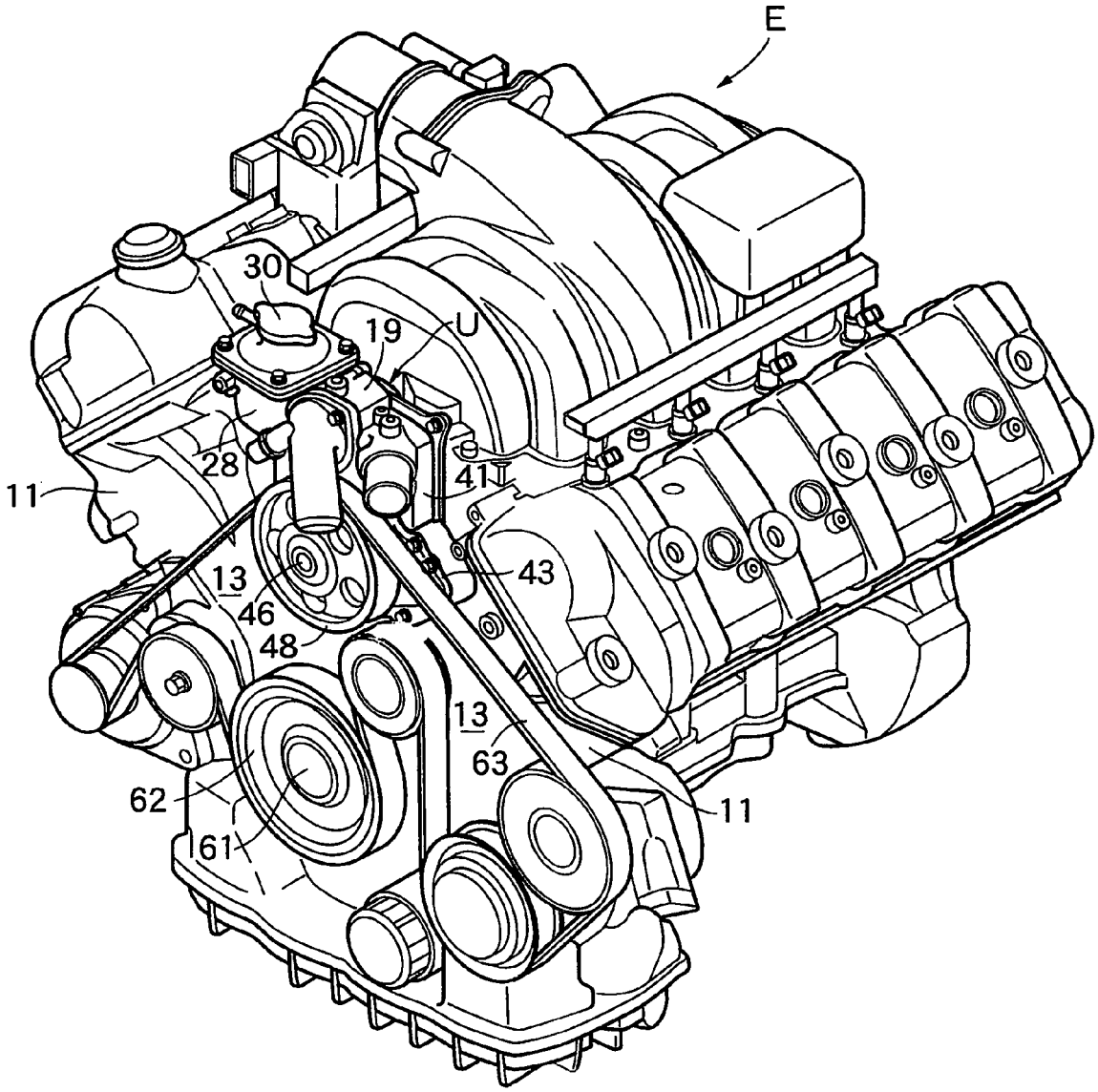

FIG. 7 shows a state in which the cooling water passage unit U having the above-mentioned arrangement is mounted on the engine E. The cooling water passage unit U is mounted on one end face, in the axial direction, of the V banks 23 (see FIG. 1), interposed between the left and right cylinder heads 11 and cylinder blocks 13 of the engine E. The water pump 20 is driven by an endless belt 63 wrapped around a pulley 62 provided on a crankshaft 61 and the pulley 48 provided on the pump shaft 46.

Since the cooling water passage unit U forms a subassembly integrally including the water pump 20, the thermostat housing 19, the gas/liquid separation chamber 28, the cooling water discharge passage P1, the upstream cooling water supply passage P2, the downstream cooling water supply passage P3, and the bypass passage P4, mounting the pre-assembled cooling water passage unit U on the engine main body as a unit can reduce the number of components, the number of assembling steps, the space, and the cost in comparison with a case where various components forming the cooling system of the engine E are individually assembled. In particular, since the rear casing 42 projects rearward relative to the mating surfaces 41*c* (mating surfaces that are joined to the engine block) formed on the rear face of the center casing 41 of the cooling water passage unit U when the cooling water passage unit U is mounted, the rear casing 42 projects into a space between the V banks 23. This allows the cooling water passage unit U to be arranged in a more compact manner by effectively utilizing the space between the V banks 23.

Next, the action of the embodiment of the present invention having the above-mentioned arrangement is explained.

Figure 8:
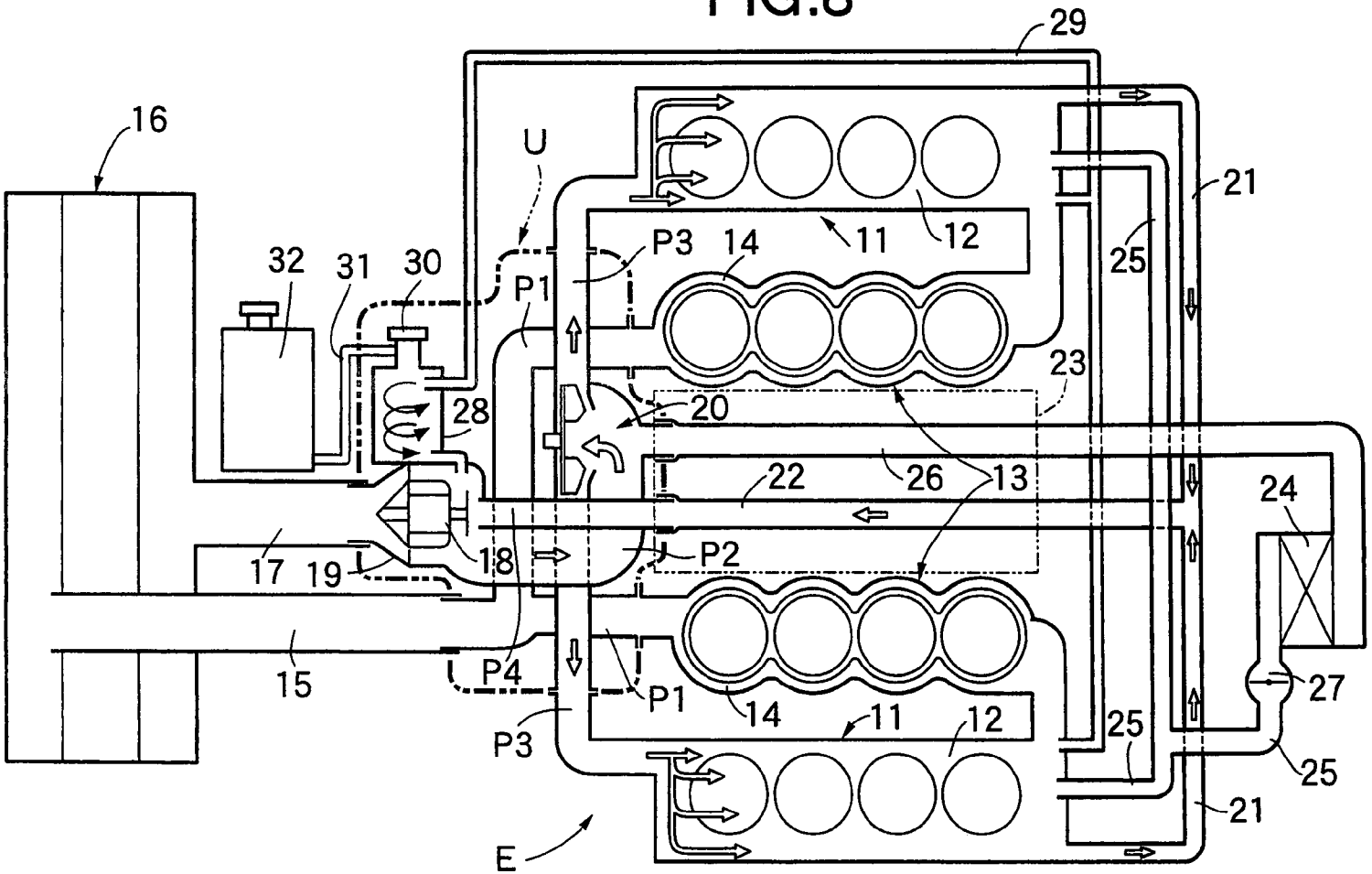

As shown in FIG. 8, when warm-up of the engine E is incomplete and the temperature of the cooling water is low, the thermostat 18 is in a closed state, communication between the second radiator hose 17 on the upstream side of the thermostat housing 19 and the upstream cooling water supply passage P2 on the downstream side thereof is cut off, and the downstream end of the bypass passage P4 communicates with the thermostat housing 19. As a result, the circuit in which the cooling water flows from the cooling water discharge passages P1 to the thermostat housing 19 via the first radiator hose 15, the radiator 16, and the second radiator hose 17 is blocked, and the cooling water pressure-fed by the water pump 20 circulates within a closed circuit including the downstream cooling water supply passages P3, the water jackets 12 of the cylinder heads 11, the bypass pipelines 21 and 22, the bypass passage P4, the thermostat housing 19, the upstream cooling water supply passage P2, and the water pump 20 to which the cooling water returns, thereby accelerating the warm-up of the engine E.

As shown in FIG. 1, when warm-up of the engine E is complete and the temperature of the cooling water becomes sufficiently high, the thermostat 18 opens, thereby providing communication between the second radiator hose 17 on the upstream side of the thermostat housing 19 and the upstream cooling water supply passage P2 on the downstream side thereof, and blocking the downstream end of the bypass passage P4. As a result, cooling water having an increased temperature after passing through the water jackets 12 and 14 of the cylinder heads 11 and the cylinder blocks 13 circulates through the cooling water discharge passages P1, the first radiator hose 15, the radiator 16, the second radiator hose 17, the thermostat housing 19, the upstream cooling water supply passage P2, the water pump 20, and the downstream cooling water supply passages P3, thereby maintaining the cooling water at an appropriate temperature.

In this state, the cooling water flowing out of the water jackets 12 of the cylinder heads 11 circulates via the heater core pipeline 25, the flow control valve 27, the heater core 24, and the heater core pipeline 26 into the upstream cooling water supply passage P2, the cooling water in the heater core 24 undergoing heat exchange with air, and the air thus having an increased temperature heating an occupant compartment. If heating is unnecessary during the summer, etc., closing the flow control valve 27 can stop supply of the cooling water to the heater core 24.

During operation of the engine E, a part of the cooling water flowing through the water jacket 12 of the cylinder head 11 and the air that collects in an upper space of the water jacket 12 are supplied to the gas/liquid separation chamber 28 via the air vent pipe 29. Since the inlet 28*a* extending to the downstream end of the air vent pipe 29 opens tangentially within the inner space of the gas/liquid separation chamber 28, a spiral flow is generated within the gas/liquid separation chamber 28 as shown by the arrow in FIG. 6, the water surface assumes a conical shape, and air collects in the center facing the pressure cap 30. Moreover, since the outlet 28*b* of the gas/liquid separation chamber 28 is also formed tangentially so as to follow the spiral flow, the water within the gas/liquid separation chamber 28 is smoothly discharged into the thermostat housing 19 through the outlet 28*b* and the passage 60. When the temperature of the cooling water increases and the pressure of the cooling water that has thermally expanded exceeds the valve opening pressure for the pressure control valve of the pressure cap 30, the valve opens, and the air that resides beneath the pressure cap 30 is vented into the reservoir 32 via the air vent pipe 31. When there is no air within the gas/liquid separation chamber 28 or the cooling water undergoes further thermal expansion after all the air is vented, the surplus cooling water drains into the reservoir 32 via the pressure cap 30 and the air vent pipe 31.

Arranging the gas/liquid separation chamber 28 as a centrifugal type in this way eliminates the need for a labyrinth structure that is required by a conventional air vent expansion tank, thereby not only cutting the cost by reducing the dimensions and simplifying the structure but also contributing to a reduction in the installation space. Moreover, since the inlet 28*a* of the gas/liquid separation chamber 28 is positioned higher than the outlet 28*b*, when water is initially poured into the cooling system with the pressure cap 30 taken off so as to pour water into the gas/liquid separation chamber 28, it is possible to minimize the amount of air supplied together with the cooling water to the cooling system through the outlet 28*b*.

Although one embodiment of the present invention is explained in detail above, the present invention can be modified in a variety of ways without departing from the spirit and scope of the present invention.

For example, the embodiment illustrates a V-type engine E, but the inventions described in claims 1 and 2 can be applied to any type of engine as well as a V-type engine. In the embodiment, the gas/liquid separation chamber 28 is provided integrally with the cooling water passage unit U, but it can be provided separately. Furthermore, in the embodiment the inlet 28*a* of the gas/liquid separation chamber 28 is positioned higher than the outlet 28*b*, but the inlet 28*a* and the outlet 28*b* can be positioned at the same height.

What is claimed is:

1. An engine cooling water passage structure for connecting to a water jacket and a radiator comprising:

a cooling water passage unit including;

a cooling water supply passage;

a water pump for connection to the cooling water supply passage;

a thermostat housing in the cooling water supply passage for housing a thermostat, wherein the cooling water passes through the water pump and through the thermostat housing when being supplied from the radiator to the water jacket;

a cooling water discharge passage for discharging cooling water from the water jacket into the radiator; and a bypass passage operably couple between the water jacket and the thermostat housing, for returning the cooling water from the water jacket to the thermostat housing and bypassing the radiator;

wherein the cooling water passage unit is formed of a plurality of divided sections, said divided sections being previously and integrally formed as a sub-assembly and this sub-assembly being detachably mounted as a unit on an engine main body.

2. The engine cooling water passage structure according to claim 1, wherein said cooling water supply passage and said cooling water discharge passage are formed to extend over said plurality of divided sections.

* * * * *